US008109660B2

(12) United States Patent
Hochstein et al.

(10) Patent No.: US 8,109,660 B2
(45) Date of Patent: Feb. 7, 2012

(54) GLOBE DEPLOYABLE LED LIGHT ASSEMBLY

(75) Inventors: Peter A. Hochstein, Troy, MI (US); Melvin L. Wolgamott, Pontiac, MI (US)

(73) Assignee: Relume Technologies, Inc., Oxford, MI (US)

( * ) Notice: Subject to any disclaimer, the term of this patent is extended or adjusted under 35 U.S.C. 154(b) by 487 days.

(21) Appl. No.: 12/471,622

(22) Filed: May 26, 2009

(65) Prior Publication Data

US 2010/0033969 A1 Feb. 11, 2010

Related U.S. Application Data

(60) Provisional application No. 61/086,846, filed on Aug. 7, 2008.

(51) Int. Cl.
*F21V 29/00* (2006.01)

(52) U.S. Cl. ..... 362/373; 362/249.03; 362/249.04; 362/249.06; 362/249.07; 362/249.08

(58) Field of Classification Search ..... 362/249.03–1, 362/14, 16, 239, 350, 186, 189, 229, 236, 362/237, 240, 244, 245, 294, 373, 329
See application file for complete search history.

(56) References Cited

U.S. PATENT DOCUMENTS

| | | | | |
|---|---|---|---|---|
| 4,719,548 | A | 1/1988 | Orosz | |
| 5,758,948 | A * | 6/1998 | Hale | 362/123 |
| 6,502,953 | B2 | 1/2003 | Hajianpour | |
| 6,666,224 | B2 * | 12/2003 | Lee | 135/16 |
| 6,955,451 | B2 | 10/2005 | Coushaine et al. | |
| 7,431,469 | B2 * | 10/2008 | Li | 362/102 |
| 7,604,015 | B2 * | 10/2009 | Fraser | 135/31 |
| 7,815,331 | B2 * | 10/2010 | Chronopoulos | 362/102 |
| 7,975,711 | B2 * | 7/2011 | Li | 135/16 |

FOREIGN PATENT DOCUMENTS

| | | |
|---|---|---|
| EP | 1978301 A1 | 10/2008 |
| JP | 2005-347056 | 12/2005 |
| JP | 2007-066658 | 3/2007 |
| JP | 095404 | 4/2007 |

OTHER PUBLICATIONS

Patent Application—Light Engine With Enhanced Heat Transfer Using Independent Elongated Strips.

* cited by examiner

*Primary Examiner* — Jong-Suk (James) Lee
*Assistant Examiner* — Mark Tsidulko
(74) *Attorney, Agent, or Firm* — Harold W. Milton, Jr.; Dickinson Wright, PLLC

(57) ABSTRACT

An L.E.D. light emitting assembly (20) includes a heat sink (50) defined by independent elongated sections (52) upwardly from a base (26) in parallel relationship. L.E.D.s (72) are disposed on a mounting surface (60) and fins (64) are disposed on a heat transfer surface (62) of the elongated sections (52). The elongated sections (52) and base (26) are pivotably connected at a hinge (86). The hinge (86) can include a spring (102). A spreader (90) can pivot the elongated sections (52) about the hinge (86). A flexible stop (106) with a resilient tip (110) is attached to top ends (58) of the elongated sections (52). The elongated sections (52) are held together by a retainer (88), such as a band (104), and inserted through a narrow opening (22) of a globe (24). A deployment mechanism (84) moves the elongated sections (52) to a non-parallel position to fill the globe (24).

28 Claims, 4 Drawing Sheets

GLOBE DEPLOYABLE LED LIGHT ASSEMBLY

CROSS REFERENCE TO RELATED APPLICATION

This application claims the benefit of provisional application Ser. No. 61/086,846 filed Aug. 7, 2008.

BACKGROUND OF THE INVENTION

1. Field of the Invention

The subject invention relates to a light emitting assembly of the type including light emitting diodes (L.E.D.s), and more particularly, light assemblies for insertion into a globe.

2. Description of the Prior Art

For over a century, municipalities have used transparent globes, such as an "Acorn" or "Type 118" luminaire to enclose and protect street light assemblies. In addition to providing protection, transparent globes are chosen over other protective covers for their appealing ornamental design. The globe is disposed around the light assembly by inserting the light assembly through a narrow opening in the bottom of the globe. Typically, in existing globes, a high-intensity discharge (H.I.D.) light bulb or a light assembly including H.I.D. lights moves into the narrow opening of the globe as the globe is moved into position to cover the light assembly. Costly reflectors or light refracting prisms are often placed around the H.I.D. lights to increase efficiency of the light assembly and direct light in a desired direction. An example of such an assembly is disclosed in U.S. Pat. No. 4,719,548 to Orosz.

Recently, municipalities desire to replace H.I.D. street light assemblies including acorn-shaped globe lamps, with L.E.D, light assemblies. L.E.D.s are more efficient than H.I.D. lights, and at least a fifty percent (50%) energy savings is possible when H.I.D. lamps are replaced with properly designed L.E.D. light assemblies. An example of such an assembly is disclosed in a PCT Application No. PCT/US2008/65874 to the inventor of the present invention, Peter Hochstein. In this Hoehstein patent application, the L.E.D.s are disposed on heat sinks including fins, and the heat sinks are appropriately spaced to effectively transfer heat away from the L.E.D.s. The expected life of such L.E.D. light assemblies can exceed 10-12 years, compared to a nominal 2-3 year life of H.I.D. lamps. An L.E.D. retrofit of standard H.I.D. street lights benefits the environment, and the L.E.D. light assemblies pay for themselves in approximately five years through the energy related cost savings.

However, existing properly designed L.E.D. light assemblies, such as the light assembly disclosed in the Hochstein patent application, do not fit through the narrow opening of the globe. L.E.D. light assemblies currently used in globes do not provide effective thermal management. Many of the prior art L.E.D. light assemblies used in globes operate at junction temperatures approaching 100 degrees Celsius, which virtually assures early degradation of the L.E.D.s. In addition to inefficient heat transfer, prior art assemblies designed to fit through the narrow opening of the globe are often inadequate because they are very small and fill only a portion of the globe, and because light from the L.E.D.s cannot be directed in a desired direction.

There remains a great need for an L.E.D. light assembly that can be inserted through the narrow opening of a globe, and also provides efficient heat transfer and directs light in a desired direction.

SUMMARY OF THE INVENTION

The invention provides a globe deployable L.E.D. light assembly which can be inserted through a narrow opening in the globe. The assembly includes a base for engaging the opening of the globe. The assembly also comprises a heat sink defined by a plurality of elongated sections independent of one another and extending upwardly from the base. A plurality of L.E.D.s are disposed on the elongated sections. The assembly also includes a deployment mechanism for inserting the elongated sections into the globe in generally parallel relationship to one another and moving the elongated sections to a non-parallel open position to fill the globe.

The subject invention also provides a method of fabricating a globe deployable L.E.D. light assembly and inserting the assembly into the globe. The method includes forming a heat sink defined by a plurality of elongated sections independent of one another, and disposing a plurality of L.E.D.s on the elongated sections. The method also includes extending the elongated sections upwardly from a base, and pivotally connecting the elongated sections and the base for allowing the elongated sections to pivot relative to the base between a generally parallel relationship to one another and a non-parallel open position.

Advantages of the Invention

The subject invention provides an L.E.D. light assembly properly designed for effective thermal management, capable of being inserted through the narrow opening of a globe, and capable of being canted at range of desired angles toward the ground. The elongated sections of the heat sink are spaced from one another to effectively transfer heat transfer away from the L.E.D.s., which prevents early degradation of the L.E.D.s. The deployment mechanism provides a simple and cost effective way for the elongated sections to be inserted into and fill the globe. The deployable mechanism of the subject invention allows the elongated sections to be canted at a range of desired angles toward the ground, so there is no need for an expensive reflector or prism. Municipalities and other entities using globe lamps can achieve the energy related cost savings provided by L.E.D.s by installing the subject invention into new globe lamps, or by replacing existing H.I.D. street light assemblies with the subject invention.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
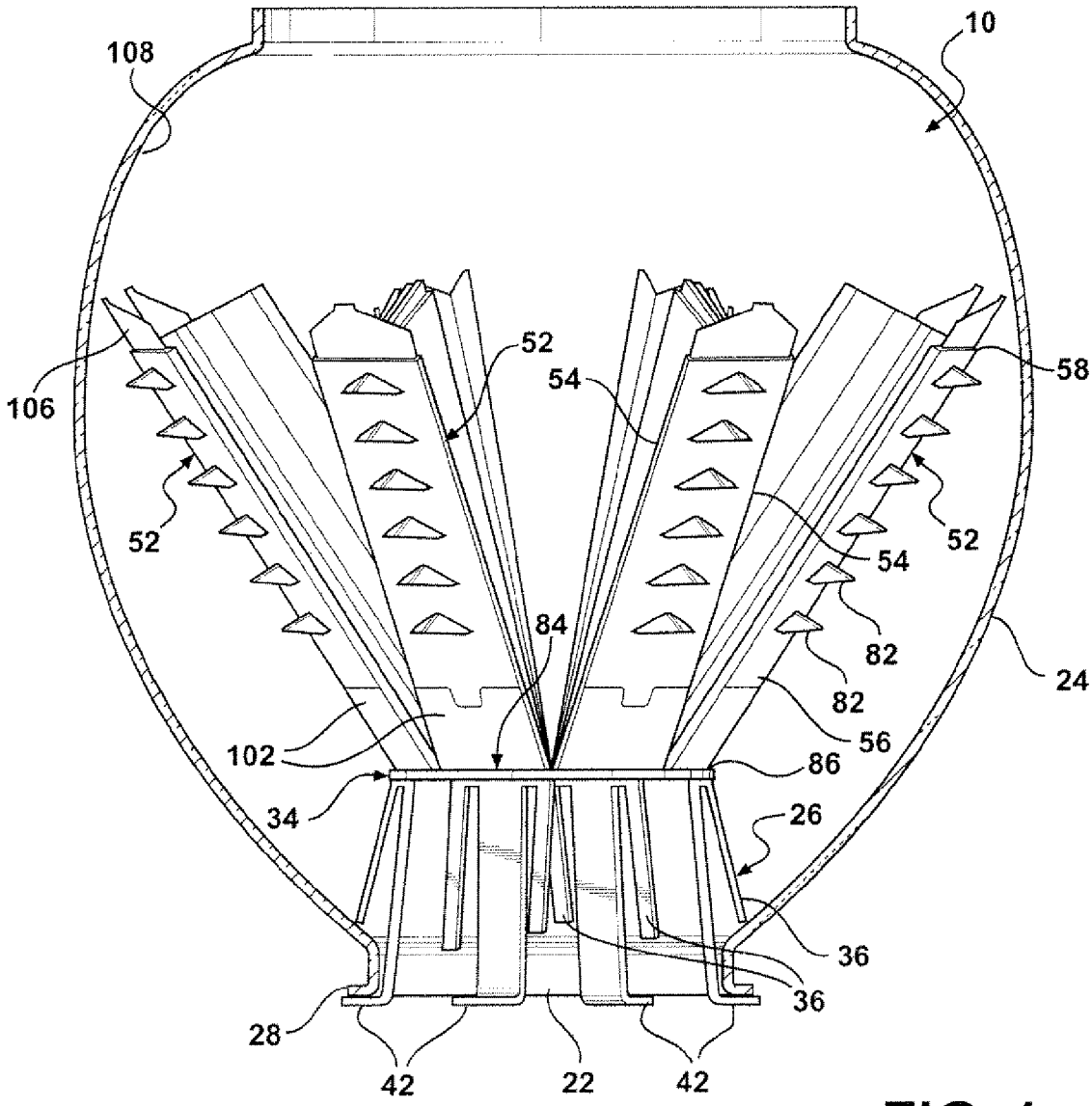
FIG. 1 is a perspective view of a preferred embodiment of the subject invention wherein a hinge includes a leaf spring.

Referring to the Figures, a light emitting assembly 20 for insertion through a narrow opening 22 in a globe 24 is generally shown. The light assembly 20 comprises a base 26, generally indicated, which typically includes a bottom flange 28 for engaging the narrow opening 22 of the globe 24. The base 26 preferably includes a plurality of base sides 30 extending into the globe 24 to an upper periphery 32 of a polygonal cross-section. The bottom flange 28 connects the base 26 to the globe 24 and secures the base 26 in a stable positive within the globe 24.

In one embodiment, the base 26 comprises a plate 34 and a plurality of legs 36 extending transversely from the bottom surface 38 of the plate 34, as shown in FIG. 1. The plate 34 has a top surface 40 extending continuously within the upper periphery 32, a bottom surface 38, and the base sides 30 defining the polygonal cross section. The legs 36 are preferably spaced around the plate 34 adjacent the base sides 30. In the embodiment shown in FIG. 1, the bottom flange 28 of the base 26 comprises a plurality of hooks 42 each extending from and homogeneous with one of the legs 36. The hooks 42 engage the narrow opening 22 of the globe 24 to secure the base 26 in a stable position within the globe 24.

Figure 3:
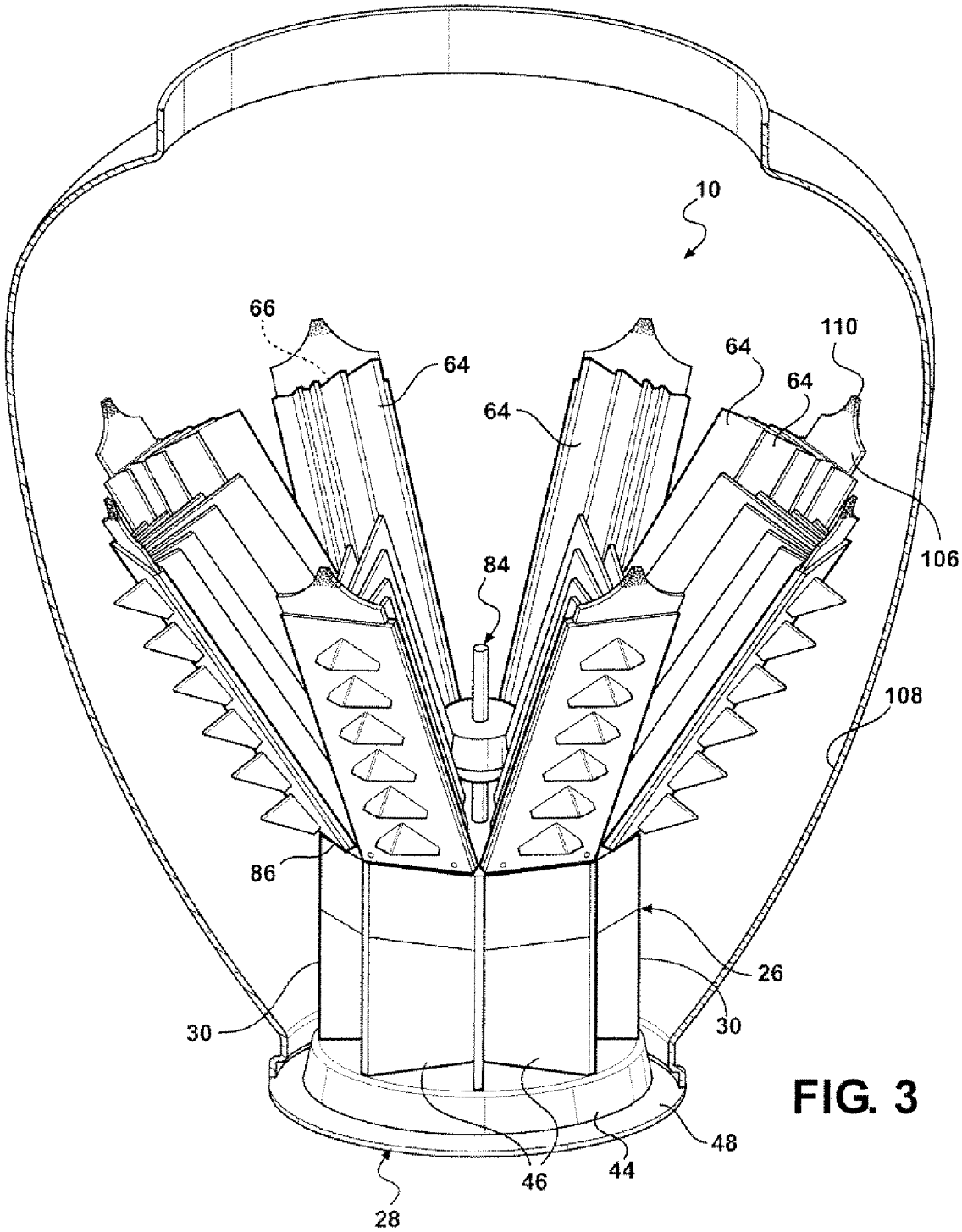
FIG. 3 is a perspective view of a second embodiment of the subject invention including a spreader.

In another embodiment, the base 26 can comprise a mounting block 44 and the base sides 30 can be further defined as a plurality of walls 46 adjoining one another and extending from the mounting block 44, as shown in FIG. 3. The walls 46 define the upper periphery 32 of a polygonal cross-section. The bottom flange 28 of the base 26 can be farther defined as a collar 48 extending radially outwardly from the mounting block 44 to the opening of the globe 24. The collar 48 extends continuously from the mounting block 44 to the opening of the globe 24 to seal the opening of the globe 24 and secure the base 26 in a stable position within the globe 24. The collar 48 can be homogeneous with the mounting block 44, as shown in FIG. 3.

Figure 2:
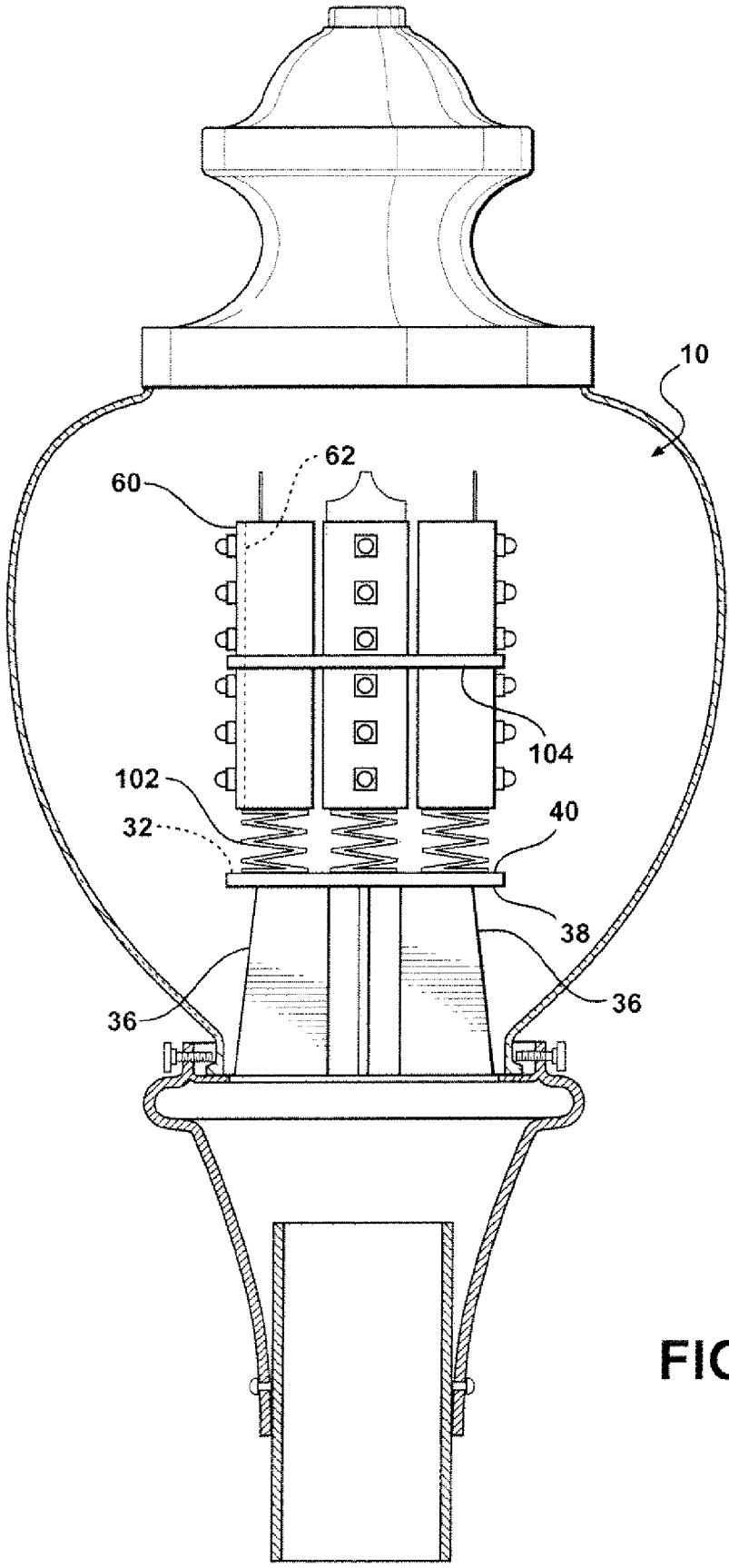
FIG. 2 is a perspective view of a preferred embodiment of the subject invention wherein the elongated sections are in generally parallel relationship to one another, the hinge includes a spiral spring, and a band encompasses the elongated sections.

The assembly 20 further comprises a heat sink 50 defined by a plurality of elongated sections 52. The elongated sections 52 are independent of one another and extend upwardly from the base 26. The elongated sections 52 are typically identical to one another and comprise side edges 54 extending continuously from a bottom end 56 to a top end 58. The bottom ends 56 of each of the elongated sections 52 are preferably disposed at one of the base sides 30 along the upper periphery 32 of the base 26, as shown in FIGS. 1-3. The elongated sections 52 can be supported by the top surface 40 of the base 26, as shown in FIG. 1. Alternatively, the elongated sections 52 can extend upwardly from the walls 46 of the base 26 along the upper periphery 32, as shown in FIG. 3. Each of the elongated sections 52 are typically disposed diametrically opposite another one of the elongated sections 52, as shown in FIGS. 1-3.

Figure 4:
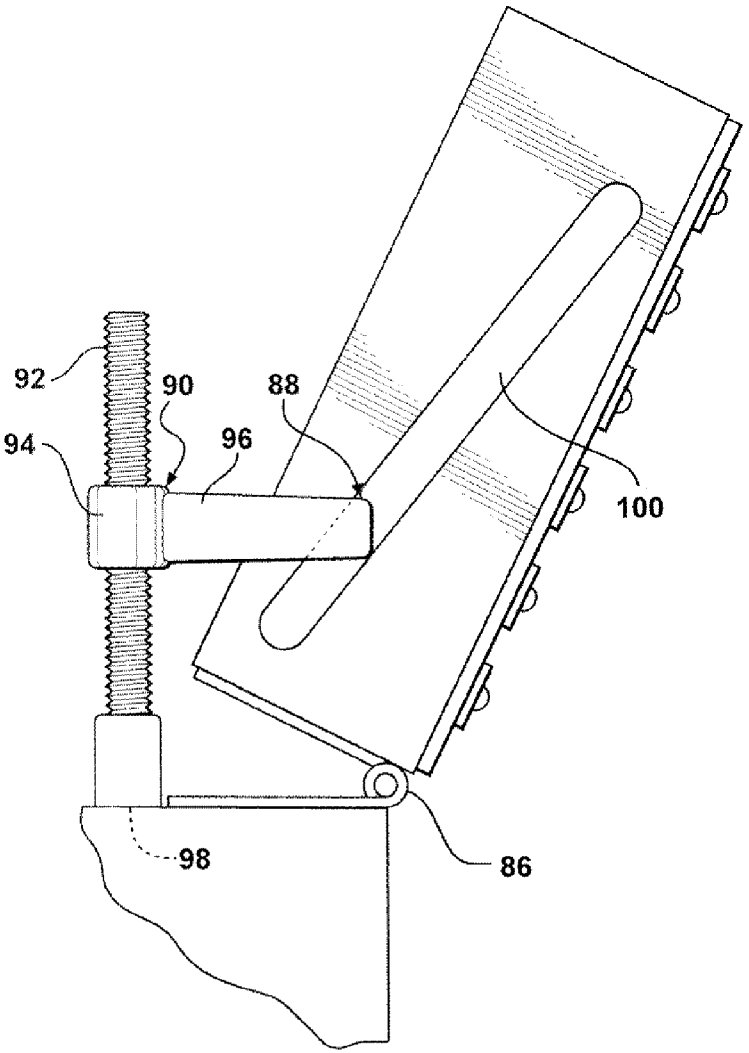
FIG. 4 is a fragmentary side view of a preferred embodiment of the subject invention showing a fin including a slot and wherein the spreader comprises a screw and spider.

The elongated sections 52 of the heat sink 50 present a mounting surface 60 and a heat transfer surface 62 facing in the opposite direction from the mounting surface 60, as shown in FIG. 4. The heat transfer surfaces 62 preferably face inwardly of the upper periphery 32 and generally toward one another, while the mounting surfaces 60 face outwardly of the upper periphery 32 and generally away from one another.

Each of the elongated sections 52 includes a plurality of fins 64 extending transversely from the heat transfer surfaces 62 of the elongated sections 52, so that the fins 64 face inwardly of the upper periphery 32 and generally toward one another. The fins 64 are disposed in spaced and parallel relationship to one another for transferring heat away from the heat sink 50 to surrounding air. The fins 64 typically extend continuously between the ends 56, 58 of each of the elongated sections 52 to present void spaces 66 between adjacent fins 64 and open at the ends 56, 58 for exposing the void spaces 66 between the adjacent fins 64 to air. The fins 64 can be parallel to one another or extend at angles relative to one another, as shown in FIGS. 1-3. The heat sink 50 and fins 64 are typically made of a thermally conductive aluminum material, such as a homogeneous aluminum or an aluminum alloy.

The assembly 20 can include an electrically insulating coating 68 disposed over the mounting surface 60 of the heat sink 50. The coating 68 is less than one thousand (1000) microns thick, but preferably less than three hundred (300) microns thick. The coating 68 may be continuous and cover the entire mounting surface 60 of the heat sink 50, or it may be disposed in circuitous tracks separated from one another by the bare metal of the heat sink 50.

Circuit traces 70 are disposed in spaced lengths from one another on the mounting surface 60 of the heat sink 50 to prevent electrical conduction between the circuit traces 70. The circuit traces 70 extend in end to end relationship along the elongated sections 52. The coating 68 prevents electrical conduction from each of the circuit traces 70 to the heat sink 50. The circuit traces 70 may consist of a polymetric material having metal particles dispersed therein, such as an epoxy compound with a noble metal, or a phenolic resin compounded with either copper, silver, or nickel.

A plurality of light emitting diodes (L.E.D.s) 72 are disposed on each of the elongated sections 52, as shown in FIG. 2. The L.E.D.s 72 are typically disposed on the mounting surfaces 60 of each of the elongated sections 52 so that they can direct light away from the light assembly 20. Typically, the L.E.D.s 72 are disposed on the mounting surface 60 to span the spaces between the ends of adjacent circuit traces 70. Each one can have a positive lead 74 and a negative lead 76 being in electrical engagement with the adjacent ones of the circuit traces 70 to electrically interconnect the circuit traces 70 and the L.E.D.s 72. An electrically conductive adhesive 78 secures the leads 74, 76 of the L.E.D.s 72 to adjacent ones of the circuit traces 70. The L.E.D.s 72 on each of the elongated sections 52 may be electrically interconnected in series with one another and electrically interconnected in parallel with the ones on other elongated sections 52. The L.E.D.s 72 on each of the elongated sections 52 are shown as having a uniform space between each adjacent L.E.D 72. However, the plurality of L.E.D.s 72 on each elongated section 52 may have non-uniform spaces between one another. The electrical components of the assembly 20 are connected with printed, foil or wire conductors.

The light assembly 20 can include a protective and conformal coating 80 of electrically insulating material disposed over the mounting surface 60, as shown in FIG. 1, to protect the L.E.D.s 72 from physical damage and moisture. The conformal coating 80 may be disposed over the L.E.D.s 72 and corresponding electrical components, including the circuit traces 70, L.E.D.s 72 and leads 74, 76, or any number of these components. The conformal coating 80 is typically a translucent and durable material, such as a two component chemically catalyzed urethane. A light shield 82 supported by the mounting surface 60 can be disposed over each of the L.E.D.s 72, as shown in FIGS. 1 and 3.

The light emitting assembly 20 includes a deployment mechanism 84, generally indicated, for inserting the elongated sections 52 into the globe 24 in generally parallel relationship to one another and moving the elongated sections 52 to a non-parallel open position to fill the globe 24. The deployment mechanism 84 preferably includes a hinge 86, generally indicated, interconnecting the base 26 and the elongated sections 52 for allowing the elongated sections 52 to pivot relative to the base 26. The elongated sections 52 are disposed in a generally parallel relationship to one another so that they can fit through the narrow opening 22 of the globe 24. Once the elongated sections 52 are disposed in the globe 24, the hinge 86 allows the elongated sections 52 to pivot relative to the base 26 and move to a non-parallel open position to fill the globe 24. The deployment mechanism 84 also includes and a retainer 88, generally indicated, for holding the elongated sections 52 in the generally parallel relationship to one another for insertion through the narrow opening 22 in the globe 24.

The deployment mechanism 84 can include a spreader 90, generally indicated, engaging the elongated sections 52 for pivoting the elongated sections 52 about the hinge 86 from the parallel relationship to the non-parallel open position. In the embodiment shown in FIG. 3, wherein the base 26 comprises a mounting block 44 and walls 46 extend upwardly from the mounting block 44, the spreader 90 can be further defined as a screw 92 extending upwardly through the base 26, and a spider 94 having a plurality of arms 96 threadedly engaging the screw 92 and extending radially from the screw 92 to engage the fins 64. The base 26 can define an aperture 98 disposed centrally of the elongated sections 52 so that the screw 92 can be inserted upwardly therethrough.

One of the fins 64 of each of the elongated section 52 can include a slot 100 extending longitudinally along at least a portion the fin 64, as shown in FIG. 4, so that the arms 96 of the spider 94 can engage each of the slots 100. A portion of the screw 92 can extend past the aperture 98 at the bottom of the base 26 and remain outside of the globe 24, so that the screw 92 can be rotated to move the spider 94 along the slots 100 to pivot the elongated sections 52 relative to the base 26 about the hinge 86. Alternatively, the spreader 90 can include a wedge wheel, captive nut, or other structure for engaging the fins 64 and pivoting the elongated sections 52. A spreader 90 is not necessary if the elongated sections 52 inherently pivot about the hinge 86 relative to the base 26 upon removal of the retainer 88, such as when the hinge 86 includes a spring 102, as shown in FIGS. 1 and 2.

As alluded to above, the hinge 86, which can include the spring 102, interconnects the base 26 and each of the bottom ends 56 of the elongated sections 52. The spring 102 can comprise a leaf spring, as shown in FIG. 1, being spring loaded for moving the elongated sections 52 to the non-parallel open position. The leaf spring 102 preferably comprises a compliant metallic material. Alternatively, the spring 102 can comprise a spiral spring, as shown in FIG. 2.

Figure 5:
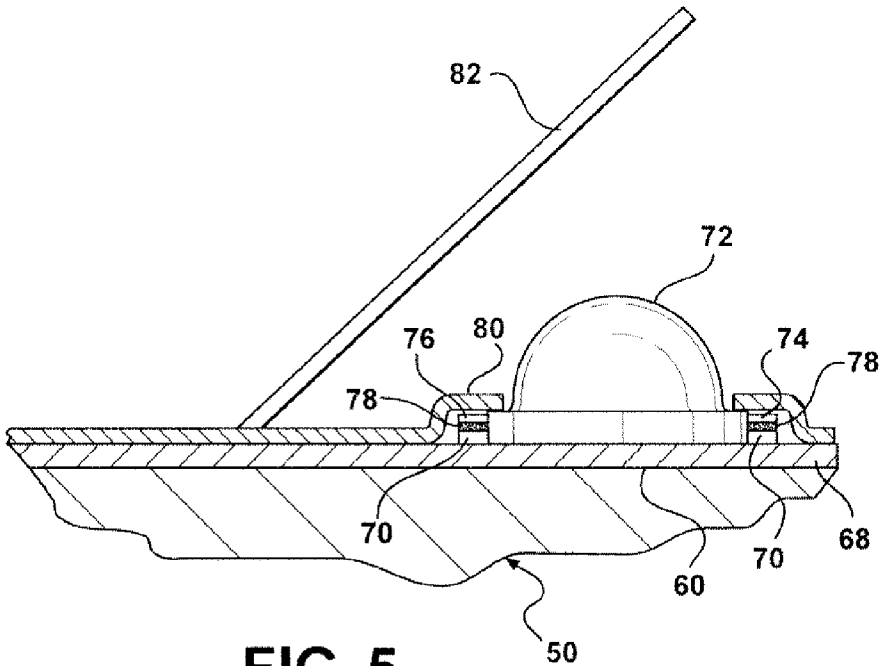
FIG. 5 is an fragmentary exploded view of an L.E.D. of the subject invention.

The retainer 88 can comprise a band 104 encompassing the elongated sections 52 for holding the elongated sections 52 in generally parallel relationship to one another for insertion through the narrow opening 22 of the globe 24, as shown in FIG. 5. In the embodiment including the leafs springs 102, the band 104 is strong enough prevent the leaf spring 102 from forcing the elongated sections 52 to the non-parallel open position. The band 104 can be cut or easily removed upon inserting the elongated sections 52 into the globe 24. In the embodiment shown in FIG. 3 including the screw 92 and spider 94, the retainer 88 is defined as the slot 100 extending longitudinally along one of the fins 64 of each of the elongated sections 52. The frictional engagement between the spider 94 and the slot 100 retains the elongated sections 52 in the parallel relationship so that the assembly 20 can be inserted into the narrow opening 22 in the globe 24. In the embodiment shown in FIG. 3, a band 104 is not required, but may be used to assist in holding the elongated sections 52 in the generally parallel relationship to one another.

The light assembly 20 preferably comprises a flexible stop 106 attached to the top ends 58 of each of the elongated sections 52, as shown in FIGS. 1-5. The flexible stops 106 arrest and position the top ends 58 of the elongated sections 52 against the globe 24 upon moving the top ends 58 of the elongated sections 52 radially outwardly to the non-parallel open position. The flexible stops 106 are spring biased so that they can be spring loaded against the globe 24. They are approximately 0.005 inches in thickness and preferably comprise a complaint material, such as a spring temper stainless steel, so that they can conform to the globe 24. In the embodiment shown in FIG. 1, including the leaf springs 102, the flexible stops 106 comprise a material being more compliant than the material of the leaf springs 102 so that the top ends 58 of each of the elongated sections 52 can be disposed adjacent the interior surface 108 of the globe 24. In other words, if the elongated sections 52 are not ideally centered in the globe 24, the top ends 58 of the elongated sections 52 may not engage the interior surface 108 of the globe 24 without the flexible stops 106. However, if included, the flexible stops 106 engage the interior surface 108 of the globe 24 and automatically adjust for centering issues.

A resilient tip 110 of a rubber material preferably covers and cushions at least a portion of each of the flexible stops 106 for preventing noise between the flexible stops 106 of the elongated sections 52 and the globe 24. The resilient tips 110 also prevent top edges of the flexible stops 106 from scratching the interior surface 108 of the globe 24 when the elongated sections 52 are pivoted about the hinge 86 to the non-parallel open position.

The subject invention also comprises a method of fabricating a light emitting assembly 20 including a base 26, a plurality of elongated sections 52 independent of one another and extending upwardly from the base 26, a plurality of L.E.D.s 72 disposed on the elongated sections 52, and a deployment mechanism 84. The subject invention also comprises a method for inserting such a light emitting assembly 20 into the globe 24.

The method of fabricating the light emitting assembly 20 comprises forming a heat sink 50 defined by a plurality of elongated sections 52 independent of one another. The elongated sections 52 can be formed by extruding a continuous strip of the heat sink 50. The strip is formed to present a mounting surface 60 and a heat transfer surface 62 facing in the opposite direction from the mounting surface 60 and includes a plurality of fins 64 extending transversely from the heat transfer surface 62. The continuous strip can then be cut into the plurality of elongated sections 52 each being identical to one another and presenting side edges 54 extending continuously between a bottom end 56 and a top end 58 to separate and render the elongated sections 52 independent of one another. Alternatively, the elongated sections 52 can be formed by casting, forging, or another fabrication method.

The method preferably includes applying a coating 68 of electrically insulating material over the mounting surface 60 of each of the elongated sections 52, and then disposing circuit traces 70 spaced from one another on the coating 68.

The method comprises disposing a plurality of L.E.D.s 72 on the elongated sections 52. Preferably, one L.E.D. 72 is disposed in each of the spaces between the circuit traces 70. The L.E.D.s 72 on each of the elongated sections 52 can be electrically interconnected in series with one another, and electrically interconnected in parallel with the L.E.D.s 72 on other elongated sections 52. The method can include disposing a conformal coating 80 over the L.E.D.s 72 and corresponding electrical components. The method can also include disposing a light shield 82 supported by the mounting surface 60 over each of the L.E.D.s 72.

Next the method includes extending the elongated sections 52 upwardly from a base 26. Preferably, the method comprises disposing a bottom end 56 of each of the elongated sections 52 along an upper periphery 32 adjacent one of the base sides 30 and extending the elongated sections 52 upwardly in generally parallel relationship to one another. The method typically includes facing the heat transfer surface 62 of each of the elongated sections 52 inwardly of the upper periphery 32 and generally toward one another, and facing the mounting surface 60 of each of the elongated sections 52 outwardly of the upper periphery 32 and generally away from one another. The method can comprise disposing each of the elongated sections 52 diametrically opposite another one of the elongated sections 52.

The method includes pivotably connecting the base 26 and each of the elongated sections 52 for allowing the elongated sections 52 to pivot relative to the base 26 between the generally parallel relationship and a non-parallel open position. The elongated sections 52 and base 26 can be pivotably connected at a hinge 86, which may include a spring 102. Preferably, the method also includes spring biasing the top ends 58 of each of the elongated sections 52, and covering and cushioning the top ends 58 of each of the elongated sections 52 with a resilient tip 110.

The method of fabricating the light assembly 20 includes disposing the light assembly 20 in a globe 24. First, the elongated sections 52 are held in a generally parallel relationship to one another by a retainer 88 so that the group of elongated sections 52 can fit through the narrow opening 22 of the globe 24. The holding of the elongated sections 52 can be further defined as encompassing a band 104 around the elongated sections 52, or by engaging a spreader 90 with a slot 100 in each of the fins 64 of the elongated sections 52.

The method next comprises inserting the elongated sections 52 upwardly into the narrow opening 22 of the globe 24 in the generally parallel relationship. The light assembly 20 can be mounted on a light pole, and the globe 24 can be placed over the light assembly 20, or the light assembly 20 can be inserted into the globe 24 independent of the light pole. Once the elongated sections 52 are inside the globe 24 so that the base 26 is disposed in a desired position relative to the narrow opening 22, the method includes moving the elongated sections 52 to the non-parallel open position to fill the globe 24. In the embodiment shown in FIG. 5, the elongated sections 52 can be moved to the non-parallel open position by sliding the band 104 toward base 26 and allowing the springs 102 to force the elongated sections 52 to the non-parallel open position, or the band 104 can be cut from around the elongated sections 52. In the embodiment shown in FIG. 3, the elongated sections 52 move to the open position by rotating a screw 92 to move a spider 94 along the slots 100 of the fins 64. The screw 92 can be rotated manually, or by a power tool or screw driver.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

What is claimed is:

1. A globe deployable L.E.D. light assembly comprising:

a base (26) for engaging the opening of a globe (24), a heat sink (50) including a plurality of elongated sections (52) independent of one another and extending upwardly from said base (26), a plurality of L.E.D.s (72) disposed on said elongated sections (52), and characterized by a deployment mechanism (84) inserting said elongated sections (52) into the globe (24) in generally parallel relationship to one another and moving said elongated sections (52) to a non-parallel open position to fill the globe (24).

2. A light emitting assembly (20) as set forth in claim 1 further characterized by said deployment mechanism (84) including a retainer (88) for holding said elongated sections (52) in the generally parallel relationship to one another for insertion through the narrow opening (22) in the globe (24).

3. A light emitting assembly as set forth in claim 2 wherein said retainer (88) is further defined as a band (104) encompassing said elongated sections (52) for holding said elongated sections (52) in generally parallel relationship to one another for insertion through the narrow opening (22) in the globe (24).

4. A light emitting assembly (20) as set forth in claim 1 further characterized by said deployment mechanism (84) including a hinge (86) interconnecting said base (26) and said elongated sections (52) for allowing said elongated sections (52) to pivot relative to said base (26) between said generally parallel relationship and said non-parallel open position.

5. A light emitting assembly as set forth in claim 4 further characterized by said hinge (86) including a spring (102) interconnecting said base (26) and each of said of said elongated sections (52) for moving said elongated sections (52) to said non-parallel open position.

6. A light emitting assembly as set forth in claim 5 wherein said spring (102) is further defined as a leaf spring.

7. A light emitting assembly as set forth in claim 5 wherein said spring (102) is further defined as a spiral spring.

8. A light emitting assembly as set forth in claim 4 further characterized by said deployment mechanism (84) including a spreader (90) engaging said elongated sections (52) for pivoting said elongated sections (52) about said hinge (86) from said generally parallel relationship to said non-parallel open position to fill the globe (24).

9. A light emitting assembly as set forth in claim 8 wherein:

each of said elongated sections (52) includes a heat transfer surface (62) extending between a top end (58) and a bottom end (56), at least one fin (64) extends transversely from said heat transfer surface (62) and between said ends (56, 58) for transferring heat away from said heat sink (50) to surrounding air, said retainer (88) is further defined as a slot (100) extending longitudinally along at least a portion of one of said fins (64) of each of said elongated sections (52), said base (26) defines an aperture (98), said spreader (90) is further defined as a screw (92) extending upwardly through said aperture (98) of said base (26) and centrally of said elongated sections (52) and a spider (94) having a plurality of arms (96) threadedly engaging said screw (92) and extending radially from said screw (92) and engaging each of said slots (100) of said fins (64) for pivoting said elongated sections (52) about said hinge (86) by rotating said screw (92) to move said spider (94) along said slots (100).

10. A light emitting assembly as set forth in claim 1 wherein each of said elongated sections (52) extend continuously from a bottom end (56) disposed at said base (26) to a top end (58), and further characterized by a flexible stop (106) attached to said top ends (58) of each of said elongated sections (52) and being spring biased for being spring loaded against the globe (24) upon moving said top ends (58) of said elongated sections (52) radially outwardly to said non-parallel open position.

11. A light emitting assembly as set forth in claim 10 further characterized by a resilient tip (110) of rubber material covering and cushioning said flexible stop (106) for preventing noise between said elongated section (52) and the globe (24).

12. A light emitting assembly as set forth in claim 10 wherein said flexible stop (106) comprises a spring temper stainless steel and is approximately 0.005 inches in thickness.

13. A light emitting assembly as set forth in claim 1 wherein said base (26) includes a bottom flange (28) for engaging the narrow opening (22) of the globe (24).

14. A light emitting assembly as set forth in claim 13 further characterized by;

said base (26) including a plate (34) having a top surface (40) extending continuously within an upper periphery (32) for supporting said elongated sections (52) and a bottom surface (38), a plurality of legs (36) extending transversely from said bottom surface (38) of said base (26), and said bottom flange (28) of said base (26) being further defined as a plurality of hooks (42) each extending from and homogeneous with one of said legs (36).

15. A light emitting assembly as set forth in claim 13 further characterized by;

said base (26) including a mounting block (44) and a plurality of walls (46) adjoining one another and extending from said mounting block (44) to said elongated sections (52), and said bottom flange (28) of said base (26) being further defined as a collar (48) extending radially outwardly from said mounting block (44) to the opening of the globe (24) for sealing the opening of the globe (24).

16. A light emitting assembly for insertion through a narrow opening in a globe and for opening to fill the globe, said assembly comprising:

a base (26) having a bottom flange (28) for engaging the narrow opening (22) of a globe (24) and extending into the globe (24) to an upper periphery (32) of a polygonal cross-section to present a plurality of base sides (30), a heat sink (50) of thermally conductive aluminum material presenting a mounting surface (60) and a heat transfer surface (62) facing in the opposite direction from said mounting surface (60), said heat sink (50) including a plurality of elongated sections (52) being identical and independent of one another and extending upwardly adjacent one another from said base sides (30) of said upper periphery (32) of said base (26), each of said elongated sections (52) presenting side edges (54) extending continuously from a bottom end (56) disposed at one of said base sides (30) of said upper periphery (32) of said base (26) to a top end (58), said heat transfer surface (62) of each of said elongated sections (52) facing inwardly of said upper periphery (32) and generally toward one another, said mounting surface (60) of each of said elongated sections (52) facing outwardly of said upper periphery (32) and generally away from one another, each of said elongated sections (52) being disposed diametrically opposite another one of said elongated sections (52), each of said elongated sections (52) including a plurality of fins (64) extending transversely from said heat transfer surface (62) of each of said elongated sections (52) and disposed in spaced and parallel relationship to one another for transferring heat away from said heat sink (50) to surrounding air, said fins (64) extending continuously between said ends (56, 58) of each of said elongated sections (52) to present void spaces (66) between adjacent fins (64) and open at said ends (56, 58) for exposing said void spaces (66) between said adjacent fins (64) to air, a coating (68) of electrically insulating material disposed over said mounting surface (60) of said elongated sections (52), said coating (68) being less than one thousand microns in thickness, a plurality of circuit traces (70) spaced from one another on said coating preventing electrical conduction between said circuit traces (70); so that said coating (68) prevents electrical conduction from each of said circuit traces (70) to said heat sink (50), a plurality of L.E.D.s (72) disposed in spaces between adjacent ones of said circuit traces (70), each of said L.E.D.s (72) having a positive lead (74) and a negative lead (76), said leads (74, 76) of each of said L.E.D.s (72) being in electrical engagement with said adjacent ones of said circuit traces (70) for electrically interconnecting said circuit traces (70) and said L.E.D.s (72), an adhesive (78) of electrically conductive material securing said leads (74, 76) to said circuit traces (70), said L.E.D.s (72) on each of said elongated sections (52) being electrically interconnected in series with one another, said L.E.D.s (72) on each of said elongated sections (52) being electrically interconnected in parallel with said L.E.D.s (72) on other elongated sections (52), a conformal coating (80) of electrically insulating material disposed over said mounting surface (60) and circuit traces (70) and said L.E.D.s (72) and said leads (74, 76) for protecting said L.E.D.s (72) and the accompanying electrical components, said conformal coating (80) comprising a transparent material and being about fifty microns in thickness, a light shield (82) supported by said mounting surface (60) over each of said L.E.D.s (72) for directing light emitting from said L.E.D.s (72) in a predetermined direction, characterized by a deployment mechanism (84) inserting said elongated section (52) into the globe;

(24) in generally parallel relationship to one another and moving said elongated sections (52) to a non-parallel open position to fill the globe (24), said deployment mechanism (84) including a retainer (88) for holding said elongated sections (52) in generally parallel relationship to one another for insertion through the narrow opening (22) in the globe (24), said deployment mechanism (84) including a retainer (88) holding said elongated sections (52);

said elongated sections (52) allowing said elongated sections (52) to pivot relative to said base (26) between said parallel relationship and said non-parallel open position a flexible stop (106) attached to said top ends (58) of each of said elongated sections (52) and being spring (102) biased for being spring (102) loaded against the globe (24) upon moving said top ends (58) of said elongated sections (52) radially outwardly to said non-parallel open position, said flexible stop (106) comprising a spring temper stainless steel, said flexible stop (106) being approximately 0.005 inches in thickness, and a resilient tip (110) of rubber material covering and cushioning said flexible stop (106) for preventing noise between said flexible stop (106) of said elongated section (52) and the globe (24).

17. A light emitting assembly as set forth in claim 16 further characterized by said retainer (88) being further defined as a band (104) encompassing said elongated sections (52) for holding said elongated sections (52) in generally parallel relationship to one another for insertion through the narrow opening (22) in the globe (24).

18. A light emitting assembly as set forth in claim 16 further characterized by said hinge (86) including a spring (102) interconnecting said base (26) and each of said bottom ends (56) of said elongated sections (52) for moving said elongated sections (52) to said non-parallel open position.

19. A light emitting assembly as set forth in claim 18 further characterized by said spring, (102) being further defined as a leaf spring.

20. A light emitting assembly as set forth in claim 18 further characterized by said spring (102) being further defined as a spiral spring.

21. A light emitting assembly as set forth in claim 16 further characterized by said deployment mechanism (84) including a spreader (90) engaging said elongated sections (52) for pivoting said elongated sections (52) about said hinge (86) from said parallel relationship to said non-parallel open position to fill the globe (24).

22. A light emitting assembly as set forth in claim 21 further characterized by;

said retainer (88) being defined by a slot (100) extending longitudinally relative to said heat transfer surface (62) between said ends (56, 58) along at least a portion of one of said fins (64) of each of said elongated sections (52), said base (26) defining an aperture (98), and said spreader (90) being further defined as a screw (92) extending upwardly through said aperture (98) of said base (26) and centrally of said elongated sections (52) and a spider (94) having a plurality of arms (96) threadedly engaging said screw (92) and extending radially from said screw (92) and engaging each of said slots (100) of said fins (64) for pivoting said elongated sections (52) about said hinge (86) by rotating said screw (92) to move said spider (94) along said slots (100).

23. A light emitting assembly as set forth in claim 16 further characterized by;

said base (26) including a plate (34) having a top surface (40) extending continuously within said upper periphery (32) for supporting said elongated sections (52) and a bottom surface (38), and a plurality of legs (36) extending transversely from said bottom surface (38) of said base (26), and said bottom flange (28) of said base (26) being further defined as a plurality of hooks (42) each extending from and homogeneous with one of said legs (36).

24. A light emitting assembly (20) as set forth in claim 16 further characterized by;

said base (26) including a mounting block (44) and a plurality of walls (46) adjoining one another and extending from said mounting block (44) to said bottom ends (56) of said elongated sections (52), and said bottom flange (28) of said base (26) being further defined as a collar (48) extending radially outwardly from said mounting block (44) to the opening of the globe (24) for sealing the opening of the globe (24).

25. A method for fabricating a globe deployable L.E.D. light assembly comprising the steps of:

forming a heat sink (50) defined by a plurality of elongated sections (52) independent of one another, disposing a plurality of L.E.D.s (72) on the elongated sections (52), extending the elongated sections (52) upwardly from a base (26), and characterized by pivotably connecting the base (26) and each of the elongated sections (52) for allowing the elongated sections (52) to pivot relative to the base (26) between a generally parallel relationship to one another and a non-parallel open position.

26. A method as set forth in claim 25 further characterized by holding the elongated sections (52) in the generally parallel relationship to one another for insertion through the narrow opening (22) in the globe (24).

27. A method as set forth in claim 25 further characterized by inserting the elongated sections (52) into the globe (24) in the generally parallel relationship to one another.

28. A method as set forth in claim 27 further characterized by moving the elongated sections (52) to the non-parallel open position to fill the globe (24).

* * * * *

UNITED STATES PATENT AND TRADEMARK OFFICE

CERTIFICATE OF CORRECTION

PATENT NO. : 8,109,660 B2
APPLICATION NO. : 12/471622
DATED : February 7, 2012
INVENTOR(S) : Hochstein et al.

It is certified that error appears in the above-identified patent and that said Letters Patent is hereby corrected as shown below:

| Col. | Line | |
|---|---|---|
| 3 | 25 | "can be farther" should read "can be further" |
| 8 | 9 | "A light emitting assembly (20)" should read "An assembly (20)" |
| 8 | 14 | (same as above) |
| 8 | 20 | (same as above) |
| 8 | 26 | (same as above) |
| 8 | 31 | (same as above) |
| 8 | 33 | (same as above) |
| 8 | 35 | (same as above) |
| 8 | 41 | (same as above) |
| 8 | 62 | (same as above) |
| 9 | 4 | (same as above) |
| 9 | 9 | (same as above) |
| 9 | 12 | (same as above) |
| 9 | 15 | (same as above) |
| 9 | 26 | (same as above) |
| 9 | 36 | "A light emitting assembly" should read "A globe deployable L.E.D. light assembly (20)" |
| 10 | 15 | "said coating" should read "said coating (68)" |
| 10 | 46, 47 | "said elongated section (52)" should read "said elongated sections (52)" |
| 10 | 47, 48 | "into the globe; (24) in..." should read "into the globe (24)" |
| 10 | 52 | "for holding" should read "holding" |
| 10 | 55, 56 | "including a retainer (88) holding said elongated sections" should read "including a hinge interconnecting said base (26) and said elongated sections (52)" |
| 11 | 7 | "A light emitting assembly" should read "An assembly (20)" |
| 11 | lines 13, 18, 22, 25, 31; and column 12 lines 1 and 12 should read (same as above) | |
| 12 | 21, 22 | "L.E.D. light assembly" should read "L.E.D. assembly (20)" |

Signed and Sealed this
Seventeenth Day of April, 2012

David J. Kappos

David J. Kappos
*Director of the United States Patent and Trademark Office*